US005248455A

United States Patent [19]

Joseph et al.

[11] Patent Number: 5,248,455

[45] Date of Patent: Sep. 28, 1993

[54] METHOD OF MAKING TRANSPARENT FILM FROM MULTILAYER BLOWN MICROFIBERS

[75] Inventors: Eugene G. Joseph, Arden Hills; James A. Rustad, North St. Paul, both of Minn.

[73] Assignee: Minnesota Mining and Manufacturing Company, St. Paul, Minn.

[21] Appl. No.: 20,132

[22] Filed: Feb. 19, 1993

Related U.S. Application Data

[62] Division of Ser. No. 768,174, Sep. 30, 1991, Pat. No. 5,190,812.

[51] Int. Cl.[5] ..... D01D 5/12; D04H 1/72

[52] U.S. Cl. ..... 264/6; 264/12; 264/115; 264/119

[58] Field of Search ..... 264/6, 12, 115, 119; 156/167

[56] References Cited

U.S. PATENT DOCUMENTS

| | | | |
|---|---|---|---|
| 3,480,502 | 11/1969 | Schrenk | 156/271 |
| 3,487,505 | 1/1970 | Chisholm et al. | 18/13 |
| 3,557,265 | 1/1971 | Chisholm et al. | 264/47 |
| 3,687,589 | 8/1972 | Schrenk | 425/109 |
| 3,759,647 | 9/1973 | Schrenk et al. | 425/131 |
| 3,825,379 | 7/1974 | Lohkamp et al. | 425/72 |
| 3,841,953 | 10/1974 | Lohkamp et al. | 161/150 |
| 3,849,241 | 11/1974 | Butin et al. | 161/169 |
| 3,924,990 | 12/1975 | Schrenk | 425/131.1 |
| 3,971,373 | 7/1976 | Braun | 128/146.2 |
| 4,103,058 | 7/1978 | Humlicek | 428/171 |
| 4,118,531 | 10/1978 | Hauser | 428/224 |
| 4,197,069 | 4/1980 | Cloeren | 425/131.1 |
| 4,295,809 | 10/1981 | Mikami et al. | 425/72 S |
| 4,375,718 | 3/1983 | Wadsworth et al. | 29/592 E |
| 4,429,001 | 1/1984 | Kolpin et al. | 428/283 |
| 4,669,163 | 6/1987 | Lux et al. | 29/125 |
| 4,720,415 | 1/1988 | Vander Wielen et al. | 428/152 |
| 4,729,371 | 3/1988 | Krueger et al. | 128/206.19 |
| 4,755,178 | 7/1988 | Insley et al. | 604/367 |
| 4,781,296 | 11/1988 | Morris et al. | 206/610 |
| 4,818,463 | 4/1989 | Buehning | 264/40.1 |
| 4,939,016 | 7/1990 | Radwanski et al. | 428/152 |
| 4,986,743 | 1/1991 | Buehning | 425/7 |
| 5,073,423 | 12/1991 | Johnson et al. | 428/40 |
| 5,100,435 | 3/1992 | Onwumere | 264/6 |

OTHER PUBLICATIONS

Wente, Van A., "Superfine Thermoplastic Fibers", *Industrial Engineering Chemistry*, vol. 48, pp. 1342–1346.

Wente, Van A. et al., "Manufacture of Superfine Organic Fibers", Report No. 4364 of the *Naval Research Laboratories*, published May 25, 1954.

*Primary Examiner*—Mary Lynn Theisen

*Attorney, Agent, or Firm*—Gary L. Griswold; Roger R. Tamte; William J. Bond

[57] ABSTRACT

Method of making a transparent film by forming two or more melt streams, combining the melt streams into a multilayer melt stream, extruding the layered melt stream and attenuating with an airstream to form multilayer microfibers, collecting the microfibers as a nonwoven web, and consolidating the web under heat and pressure. At least one of the melt streams is a thermoplastic elastomer and at least one of the melt streams is a thermoplastic material. The transparent web has a generally continuous elastomeric phase with an included array of thermoplastic microfibers.

5 Claims, 5 Drawing Sheets

METHOD OF MAKING TRANSPARENT FILM FROM MULTILAYER BLOWN MICROFIBERS

This is a division of application Ser. No. 07/768,174 filed Sep. 30, 1991, now U.S. Pat. No. 5,190,812.

FIELD OF THE INVENTION

The invention relates to tamper indicating film specifically film that will turn opaque on deformation. The novel film is formed of nonwoven webs include melt-blown microfibers which fibers are comprised of longitudinally distinct polymeric layers of at least one elastomeric or low modulus material and a second higher modulus or non-elastomeric material.

BACKGROUND OF THE INVENTION

It has been proposed in U.S. Pat. No. 3,841,953 to form nonwoven Webs of melt-blown fibers using polymer blends, in order to obtain webs having novel properties. A problem with these webs however is that the polymer interfaces causes weaknesses in the individual fibers that causes severe fiber breakage and weak points. The web tensile properties reported in this patent are generally inferior to those of webs made of corresponding single polymer fibers. This web weakness is likely due to weak points in the web from incompatible polymer blends and the extremely short fibers in the web.

A method for producing bicomponent fibers in a melt-blown process is disclosed in U.S. Pat. No. 4,729,371. The polymeric materials are fed from two conduits which meet at a 180 degree angle. The polymer flowstreams then converge and exit via a third conduit at a 90 degree angle to the two feed conduits. The two feedstreams form a layered flowstream in this third conduit, which bilayered flowstream is fed to a row of side-by-side orifices in a melt-blowing die. The bilayered polymer melt streams extruded from the orifices are then formed into microfibers by a high air velocity attenuation or a "melt-blown" process. The product formed is used specifically to form a web useful for molding into a filter material. The process disclosed concerns forming two-layer microfibers. The process also has no ability to produce webs where web properties are adjusted by fine control over the fiber layering arrangements and/or the number of layers. There is also not disclosed a stretchable and preferably high strength web.

SUMMARY OF THE INVENTION

The present invention is directed to films formed from non-woven web of longitudinally layered melt-blown microfibers, comprising layers of a low modulus or elastomeric materials and adjacent layers of higher modulus or non-elastomeric materials. The microfibers may be produced by a process comprising first feeding separate polymer melt streams to a manifold means, optionally separating at least one of the polymer melt streams into at least two distinct streams, and combining all the melt streams, including the separated streams, into a single polymer melt stream of longitudinally distinct layers, preferably of the at least two different polymeric materials arrayed in an alternating manner. The combined melt stream is then extruded through fine orifices and formed into a highly conformable and stretchable web of melt-blown microfibers. The fibers are then consolidated under heat and pressure to form a substantially clear film. The film turns opaque when stretched.

DESCRIPTION OF THE PREFERRED EMBODIMENTS

Figure 1:
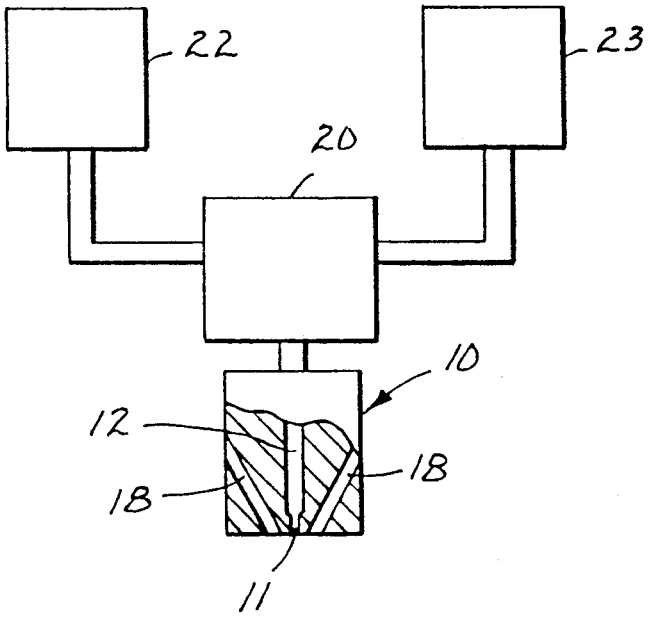
FIG. 1 is a schematic view of an apparatus useful in the practice of the invention method.

The microfibers produced are prepared, in part, using the apparatus discussed, for example, in Wente, Van A., "Superfine Thermoplastic Fibers," *Industrial Engineering Chemistry,* Vol. 48, pp 1342–1346 and in Wente, Van A. et al., "Manufacture of Superfine Organic Fibers," Report No. 4364 of the Naval Research Laboratories, published May 25, 1954, and U.S.. Pat. Nos. 3,849,241 (Butin et al.), 3,825,379 (Lohkamp et al.), 4,818,463 (Buehning), 4,986,743 (Buehning), 4,295,809 (Mikami et al.) or 4,375,718 (Wadsworth et al.). These apparatuses and methods are useful in the invention process in the portion shown as die 10 in FIG. 1, which could be of any of these conventional designs.

The microfibers can be formed using a conduit arrangement as disclosed in U.S. Pat. No. 4,729,371 or as discussed in copending patent application "NOVEL MATERIAL AND MATERIAL PROPERTIES FROM MULTI-LAYER BLOWN MICROFIBER WEBS" (E. G. Joseph and D. E. Meyers, inventors), which is being filed concurrently with the present application as Ser. No. 07/769,206 and filing date on Sep. 30, 1991.

The polymeric components are introduced into the die cavity 12 of die 10 from a separate splitter, splitter region or combining manifold 20, and into the, e.g., splitter from extruders, such as 22 and 23. Gear pumps and/or purgeblocks can also be used to finely control the polymer flowrate. In the splitter or combining manifold 20, the separate polymeric component flowstreams are formed into a single layered flowstream. However, preferably, the separate flowstreams are kept out of direct contact for as long a period as possible prior to reaching the die 10. The separate polymeric flowstreams from the extruder(s) can be split in the splitter (20). The split or separate flowstreams are combined only immediately prior to reaching the die. This minimizes the possibility of flow instabilities generating in the separate flowstreams after being combined in the single layered flowstream, which tends to result in non-uniform and discontinuous longitudinal layers in the multi-layered microfibers. Flow instabilities can also have adverse effects on non-woven web properties such as modulus, temperature stability, or other desirable properties obtainable with the invention process.

The separate flowstreams are also preferably established into laminar flowstreams along closely parallel flowpaths. The flowstreams are then preferably combined so that at the point of combination, the individual flows are laminar, and the flowpaths are substantially parallel to each other and the flowpath of the resultant combined layered flowstream. This again minimizes turbulence and lateral flow instabilities of the separate flowstreams in and after the combining process.

It has been found that a suitable splitter 20, for the above-described step of combining separate flowstreams, is one such as is disclosed, for example, in U.S. Pat. No. 3,557,265, which describes a manifold that forms two or three polymeric components into a multi-layered rectilinear melt flow. The polymer flowstreams from separate extruders are fed into plenums then to one of the three available series of ports or orifices. Each series of ports is in fluid communication with one of the plenums. Each stream is thus split into a plurality of separated flowstreams by one of the series of ports, each with a height-to-width ratio of from about 0.01 to 1. The separated flowstreams, from each of the three plenum chambers, are then simultaneously coextruded by the three series of parts into a single channel in an interlacing manner to provide a multi-layered flowstream. The combined, multi-layered flowstream in the channel is then transformed (e.g., in a coat hanger transition piece), so that each layer extruded from the manifold orifices has a substantially smaller height-to-width ratio to provide a layered combined flowstream at the die orifices with an overall height of about 50 mils or less, preferably 15–30 mils or less. The width of the flowstream can be varied depending on the width of the die. Other suitable devices for providing a multi-layer flowstream are such as disclosed in U.S. Pat. Nos. 3,924,990 (Schrenk); 3,687,589 (Schrenk); 3,759,647 (Schrenk et al.) or 4,197,069 (Cloeren), all of which, except Cloeren, disclose manifolds for bringing together diverse polymeric flowstreams into a single, multi-layer flowstream that is ordinarily sent through a coat hanger transition piece or neck-down zone prior to the film die outlet. The Cloeren arrangement has separate flow channels in the die cavity. Each flow channel is provided with a back-pressure cavity and a flow-restriction cavity, in successive order, each preferably defined by an adjustable vane. The adjustable vane arrangement permits minute adjustments of the relative layer thicknesses in the combined multi-layered flowstream. The multi-layer polymer flowstream from this arrangement need not necessarily be transformed to the appropriate length/width ratio, as this can be done by the vanes, and the combined flowstream can be fed directly into the die cavity 12.

From the die cavity 12, the multi-layer polymer flowstream is extruded through an array of side-by-side orifices 11. As discussed above, prior to this extrusion, the feed can be formed into the appropriate profile in the cavity 12, suitably by use of a conventional coat hanger transition piece. Air slots 18, or the like, are disposed on either side of the row of orifices 11 for directing uniform heated air at high velocity at the extruded layered melt streams. The air temperature is generally about that of the meltstream, although preferably 20°–30° C. higher than the polymer melt temperature. This hot, high-velocity air draws out and attenuates the extruded polymeric material, which will generally solidify after traveling a relatively short distance from the die 10. The solidified or partially solidified fibers are then formed into a web by known methods and collected (not shown). The collecting surface can be a solid or perforated surface in the form of a flat surface or a drum, a moving belt, or the like. If a perforated surface is used, the backside of the collecting surface can be exposed to a vacuum or low-pressure region to assist in the deposition of fibers, such as is disclosed in U.S. Pat. No. 4,103,058 (Humlicek). This low-pressure region allows one to form webs with pillowed low-density regions. The collector distance can generally be from 3 to about 30 inches from the die face. With closer placement of the collector, the fibers are collected when they have more velocity and are more likely to have residual tackiness from incomplete cooling. This is particularly true for inherently more tacky thermoplastic materials, such as thermoplastic elastomeric materials. Moving the collector closer to the die face, e.g., preferably 3 to 12 inches, will result in stronger inter-fiber bonding and a less lofty web. Moving the collector back will generally tend to yield a loftier and less coherent web.

The temperature of the polymers in the splitter region is generally about the temperature of the higher melting point component as it exits its extruder. This splitter region or manifold is typically integral with the die and is kept at the same temperature. The temperature of the separate polymer flowstreams can also be controlled to bring the polymers closer to a more suitable relative viscosity. When the separate polymer flowstreams converge, they should generally have an apparent viscosity of from 150 to 800 poise (as measured by a capillary rheometer). The relative viscosities of the separate polymeric flowstreams to be converged should generally be fairly well matched. Empirically, this can be determined by varying the temperature of the melt and observing the crossweb properties of the collected web. The more uniform the crossweb properties, the better the viscosity match. The overall viscosity of the layered combined polymeric flowstream(s) at the die face should be from 150 to 800 poise, preferably from 200 to 400 poise. The differences in relative viscosities are preferably generally the same as when the separate polymeric flowstreams are first combined. The apparent viscosities of the polymeric flowstream(s) can be adjusted at this point by varying the temperatures as per U.S. Pat. No. 3,849,241 (Butin, et al).

The size of the polymeric fibers formed depends to a large extent on the velocity and temperature of the attenuating airstream, the orifice diameter, the temperature of the melt stream, and the overall flow rate per orifice. At high air volume rates, the fibers formed have an average fiber diameter of less than about 10 micrometers, however, there is an increased difficulty in obtaining webs having uniform properties as the air flow rate increases. At more moderate air flow rates, the polymers have larger average diameters, however, with an increasing tendency for the fibers to entwine into formations called "ropes". This is dependent on the polymer flow rates, of course, with polymer flow rates in the range of 0.05 to 0.5 gm/min/orifice generally being suitable. Coarser fibers, e.g., up to 25 micrometers or more, can be used in certain circumstances such as large pore, or coarse, filter webs.

The multi-layer microfibers of the invention can be admixed with other fibers or particulates prior to being collected. For example, sorbent particulate matter or fibers can be incorporated into the coherent web of blown multi-layered fibers as discussed in U.S. Pat. Nos. 3,971,373 or 4,429,001. In these patents, two separate streams of melt-blown fibers are established with the streams intersecting prior to collection of the fibers. The particulates, or fibers, are entrained into an airstream, and this particulate-laden airstream is then directed at the intersection point of the two microfiber streams. Other methods of incorporating particulates or fibers, such as staple fibers, bulking fibers or binding fibers, can be used with the invention melt-blown microfiber webs, such as is disclosed, for example, in U.S. Pat. Nos. 4,118,531, 4,429,001 or 4,755,178, where particles or fibers are delivered into a single stream of melt-blown fibers.

Other materials such as surfactants or binders can be incorporated into the web before, during or after its collection, such as by use of a spray jet. If applied before collection, the material is sprayed on the stream of microfibers, with or without added fibers or particles, traveling to the collection surface.

After formation of the web, the web is subjected to a consolidation treatment under heat and pressure to form a film, that is preferably substantially clear. The film is compressed at a temperature and pressure sufficient to soften the elastomeric component, however, preferably not at conditions that will cause the non-elastomeric component to soften. The film is compressed for a period sufficient to cause the fibers to consolidate into a clear film.

The microfibers are formed from a low modulus material forming one layer or layers and a relatively nonelastic material forming the other layer or layers.

Low modulus material refers to any material that is capable of substantial elongation, e.g. preferably greater than about 100 percent, without breakage at low stress levels. The Young's modulus is generally in the range of from about $10^4$ to $10^7$ N/m$^2$ and preferably less than $10^6$ N/m$^2$. These are typically elastomers which generally is a material that will substantially resume its shape after being stretched. Such elastomers will preferably exhibit permanent set of about 20 percent or less, preferably 10 percent or less, when stretched at moderate elongations, preferably of about 300–500 percent. Elastomers include materials or blends, which are capable of undergoing elongations preferably of up to 700–800%, and more at room temperatures.

The relatively non-elastic material is generally a more rigid or higher modulus material capable of being coextruded with the elastomeric low modulus material. Further, the relatively non-elastic material must undergo permanent deformation or cold stretch at the stretch percentage that the elastomeric low modulus material will undergo without significant elastic recovery. The Young's modulus of this material should generally be greater than $10^6$ N/m$^2$ and preferably greater than $10^7$ N/m$^2$.

Webs and the films formed from the multilayer microfibers exhibit a remarkable extensibility without web breakage. This is believed to be attributable to a unique complimentary combination of properties from the individual layers in the multilayer fibers and from the interfiber relationships in the web as a whole. These properties are substantially retained in the consolidated films.

The consolidated films are provided with a generally continuous elastomeric phase having included microfibers of the non-elastomeric material. These microfibers have substantially the same cross sectional dimensions as the non-elastomeric layers in the web fibers held together by the consolidated elastomeric phase. The non-elastomeric microfibers have an average thickness of less than 10 micrometers, the thickness can be less than 1 micrometer, with a thickness of less than 0.1 micrometer obtainable. The fibers thickness being the smallest fiber cross sectional dimension. The fibers will form an interlocking network of entangled fibers. In comparison, consolidated webs of the relatively high modulus material will be substantially opaque, boardy web unless melted, in which case it will form a rigid film. Similarly, the relatively low modulus material will form a film without a network of entangled fibers or an opaque web.

When used as a tape backing, the film can be coated with any conventional hot melt, solvent coated, or like adhesive suitable for application to nonwoven webs. These adhesives can be applied by conventional techniques, such as: solvent coating; by methods such as reverse roll, knife-over-roll, wire wound rod, floating knife or air knife, hot melt coating such as; by slot orifice coaters, roll coaters or extrusion coaters, at appropriate coating weights. The extensible nature of the web can have considerable effects on a previously applied adhesive layer. Thus, the amount of adhesive surface available for contact to a substrate will likely be significantly reduced. The tape could thus be used for single application purposes and be rendered nonfunctional when removed (as the web tape backing could be designed to yield when removed) if the adhesion is reduced to an appropriate level. This would make the tape well suited for certain tamper indicating uses as well as with products designed for single use only. Adhesives can also be applied after the web has been extended or stretched. Preferred for most applications would be pressure-sensitive adhesives.

The elastomeric material can be any such material suitable for processing by melt blowing techniques. This would include polymers such as polyurethanes (e.g. "Morthane TM", available from Morton Thiokol Corp.); A-B block copolymers where A is formed of poly(vinyl arene) moieties such as polystyrene, and B is an elastomeric mid-block such as a conjugated diene or a lower alkene in the form of a linear di- or tri-block copolymer, a star, radial or branched copolymer, such as elastomers sold as "KRATON TM" (Shell Chemical Co.); polyetheresters (such as "Arnitel TM" available from Akzo Plastics Co.); or polyamides (such as "Pebax TM" available from Autochem Co.). Copolymers and blends can also be used. Other possible materials include ethylene copolymers such as ethylene vinyl acetates, ethylene/propylene copolymer elastomers or ethylene/propylene/diene terpolymer elastomers. Blends of all the above materials are also contemplated provided that the resulting material has a Young's modulus of approximately $10^7$ N/m$^2$ or less, preferably $10^6$ N/m$^2$ or less.

For extremely low modulus elastomers, it may be desirable to provide greater rigidity and strength. For example, up to 50 weight percent, but preferably less than 30 weight percent, of the polymer blend can be stiffening aids such as polyvinylstyrenes, polystyrenes such as poly(alpha-methyl)styrene, polyesters, epoxies, polyolefins, e.g., polyethylene or certain ethylene/vinyl acetates, preferably those of higher molecular weight, or coumarone-indene resin.

Viscosity reducing materials and plasticizers can also be blended with the elastomers and low modulus extensible materials such as low molecular weight polyethylene and polypropylene polymers and copolymers, or tackifying resins such as Wingtack TM aliphatic hydrocarbon tackifiers available from Goodyear Chemical Company. Tackifiers can also be used to increase the adhesiveness of an elastomeric low modulus layer to a relatively nonelastic layer. Examples of tackifiers include aliphatic or aromatic liquid tackifiers, polyterpene resin tackifiers, and hydrogenated tackifying resins. Aliphatic hydrocarbon resins are preferred.

The relatively nonelastomeric layer material is a material capable of elongation and permanent deformation as discussed above, which are fiber forming. Useful materials include polyesters, such as polyethylene terephthalate; polyalkylenes, such as polyethylene or polypropylene; polyamides, such as nylon 6; polystyrenes; or polyarylsulfones. Also useful are certain slightly elastomeric materials such as some olefinic elastomeric materials such as some ethylene/propylene, or ethylene/propylene/diene elastomeric copolymers or other ethylenic copolymers such as some ethylene vinyl acetates.

Conventional additives can be used in any material or polymer blend.

Theoretically, for webs formed from the above described two types of layers either one can advantageously comprise 1 to 99 volume percent of the total fiber volume, however, preferably the elastomeric material will comprise at least about 40 of the fiber volume. Below this level the elastomeric material might not be present in quantities sufficient to create a solid film.

The number of layers obtainable with the invention process is theoretically unlimited. Practically, the manufacture of a manifold, or the like, capable of splitting and/or combining multiple polymer streams into a very highly layered arrangement would be prohibitively complicated and expensive. Additionally, in order to obtain a flowstream of suitable dimensions for feeding to the die orifices, forming and then maintaining layering through a suitable transition piece can become difficult. A practical limit of 1,000 layers is contemplated, at which point the processing problems would likely outweigh any potential added property benefits.

The webs formed can be of any suitable thickness for the desired intended end use. However, generally a thickness from 0.01 to 5 centimeters is suitable for most applications. Thinner webs provide thinner films which are preferred for tamper indicating purposes, as these films will deform more readily. When deformed, the films turn opaque almost immediately and retain a permanent set. However, the film will exhibit some elastic behavior after having been stretched or deformed, at least to the level of previous extension. Generally, the change in opacity change on elongation is noticeable after approximately a 5 percent change in length.

The film also demonstrates a drastic increase in moisture vapor transmission when deformed or stretched by about 20% or more. This increase can be as high as 1000% or more, preferably 2000% or more, however, retaining good water or liquid holdout. This is advantageous in numerous applications.

A further contemplated use for the film is as a tape backing capable of being firmly bonded to a substrate, and removed therefrom by stretching the backing at an angle less than about 35°. These tapes are useful as mounting and joining tapes or for removable labels or the like. The extensible backing deforms along a propagation front (having a Young's modulus of less than 50,000 PSI and preferably between 5,000 and 30,000 PSI) creating a concentration of stress at the propagation front. This stress concentration results in adhesive failure at the deformation propagation front at relatively low forces. The tape can thus be removed cleanly at low forces, without damage to the substrate, yet provide a strong bond in use. The adhesive for this application should generally be extensible, yet can otherwise be of conventional formulations such as tackified natural or synthetic rubber pressure-sensitive adhesives or acrylic based adhesives. When applied, the tape should be unstretched or stretched to a low extent (e.g. to enhance conformability) so that the backing is still highly extensible (e.g., greater than 50%, and preferably greater than 150%).

The following examples are provided to illustrate presently contemplated preferred embodiments and the best mode for practicing the invention, but are not intended to be limiting thereof.

Tensile Modulus

Tensile modulus data on the multi-layer BMF webs was obtained using an Instron Tensile Tester (Model 1122) with a 10.48 cm (2 in.) jaw gap and a crosshead speed of 25.4 cm/min. (10 in./min.). Web samples were 2.54 cm (1 in.) in width. Elastic recovery behavior of the webs was determined by stretching the sample to a predetermined elongation and measuring the length of the sample after release of the elongation force and allowing the sample to relax for a period of 1 minute. The tensile modulus at elevated temperatures were measured on a Rhemotric TM RSAII in the strain sweep mode.

Wide Angle X-Ray Scattering Test

X-Ray diffraction data were collected using a Philips APD-3600 diffractometer (fitted with a Paur HTK temperature controller and hot stage). Copper $K\alpha$ radiation was employed with power tube settings of 45 kV and 4 mA and with intensity measurements made by means of a Scintillation detector. Scans within the 2–50 degree ($2\Theta$) scattering region were performed for each sample at 25 degrees C. and a 0.02 degree step increment and 2 second counting time.

Thermal Properties

Melting and crystallization behavior of the polymeric components in the multi-layered BMF webs were studied using a Perkin-Elmer Model DSC-7 Differential Scanning Calorimeter equipped with a System 4 analyzer. Heating scans were carried out at 10° or 20° C. per minute with a holding time of three (3) minutes above the melting temperature followed by cooling at a rate of 10° C. per minute. Areas under the melting endotherm and the crystallization exotherm provided an indication of the amount of crystallinity in the polymeric components of the multi-layered BMF webs.

EXAMPLE 1

A polypropylene/polyurethane multi-layer BMF web of the present invention was prepared using a melt-blowing process similar to that described, for example, in Wente, Van A., "Superfine Thermoplastic Fibers," in *Industrial Engineering Chemistry,* Vol. 48, pages 1342 et seq (1956), or in Report No. 4364 of the Naval Research Laboratories, published May 25, 1954, entitled "Manufacture of Superfine Organic Fibers" by Wente, Van A.; Boone, C. D.; and Fluharty, E. L., except that the BMF apparatus utilized two extruders, each of which was equipped with a gear pump to control the polymer melt flow, each pump feeding a five-layer feedblock (splitter) assembly similar to that described in U.S. Pat. Nos. 3,480,502 (Chisholm et al.) and 3,487,505 (Schrenk) which was connected to a melt-blowing die having circular smooth surfaced orifices (10/cm) with a 5:1 length to diameter ratio. The first extruder (260° C.) delivered a melt stream of a 800 melt flow rate (MFR) polypropylene (PP) resin (Escorene TM PP-3495G, available from Exxon Chemical Corp.), to the feedblock assembly which was heated to about 260° C. The second extruder, which was maintained at about 220° C., delivered a melt stream of a poly(esterurethane) (PU) resin ("Morthaner TM" PS 455-200, available from Morton Thiokol Corp.) to the feedblock. The feedblock split the two melt streams. The polymer melt streams were merged in an alternating fashion into a five-layer melt stream on exiting the feedblock, with the outer layers being the PP resin. The gear pumps were adjusted so that a 25:75 gear ratio PP:PU polymer melt was delivered to the feedblock assembly and a 0.14 kg/hr/cm die width (0.8 lb/hr/in.) polymer throughput rate was maintained at the BMF die (260° C.). The primary air temperature was maintained at approximately 220° C and at a pressure suitable to produce a uniform web with a 0.076 cm gap width. Webs were collected at a collector to BMF die distance of 30.5 cm (12 in.). The resulting BMF web, comprising five-layer microfibers having an average diameter of less than about 10 micrometers, had a basis weight of 50 g/m$^2$.

EXAMPLE 2

A BMF web having a basis weight of 100 g/m$^2$ and comprising 27 layer microfibers having an average diameter of less than about 10 micrometers was prepared according to the procedure of Example 1 except that the PP and PU melt streams were delivered to the 27 layer feed block in a 25:75 ratio. A transparent film was prepared by compressing the resulting BMF web at 120° C. and 178,000N for approximately 60 seconds. A photomicrograph of the fracture surface obtained by fracturing the film at liquid nitrogen temperatures clearly showed the presence of the multi-layered microfibers, even after compression at elevated temperatures to produce a clear film. The opacity of this sample was measured at various elongations using a Bausch & Lomb opacity tester having a scale of 0 to 10 with 10 representing a completely opaque sample. The opacity of the sample was 1.0.

EXAMPLE 3

A transparent film was prepared by compressing 2 layers of the BMF web of EXAMPLE 2 at 120° C. and 178,000N for approximately 60 seconds. The opacity measured was 1.5.

EXAMPLE 4

A BMF web having a basis weight of 100 g/m$^2$ and comprising 27 layer microfibers having an average diameter of less than about 10 micrometers was prepared according to the procedure of Example 1 except that the PP and PU melt streams were delivered to the 27 layer feed block in a 50:50 ratio. A transparent film was prepared by compressing the resulting BMF web at 120° C. and 178,000N for approximately 60 seconds. The opacity was 1.3.

EXAMPLE 5

A transparent film was prepared by compressing 2 layers of the BMF web of EXAMPLE 4 at 120° C. and 178,000N for approximately 60 seconds. The opacity was 1.5.

EXAMPLE 6

A transparent film was prepared by compressing 1 layer of the BMF web of EXAMPLE 1 at 120° C. and 178,000N for approximately 60 seconds. The opacity was 1.1.

Figure 8:
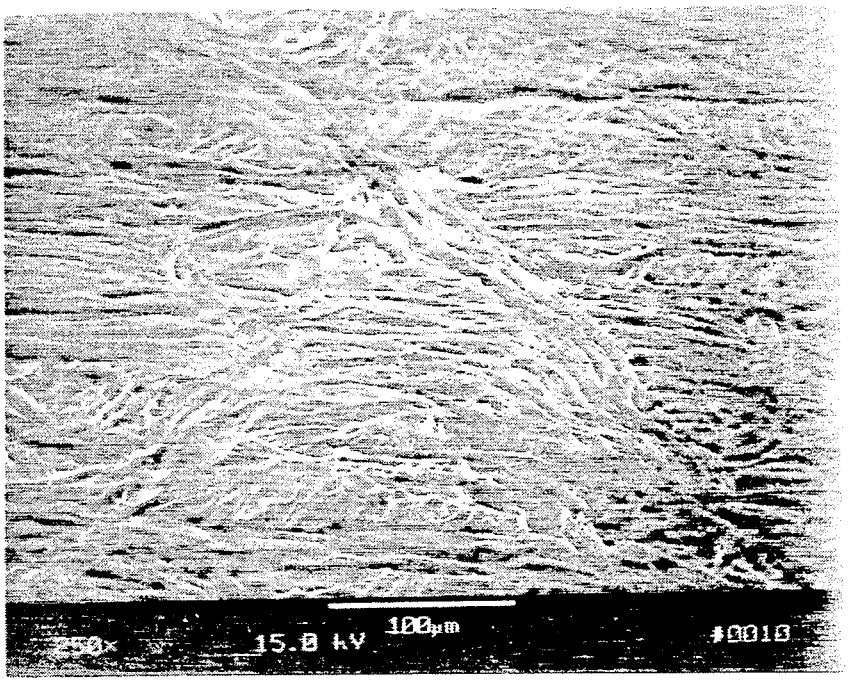
FIGS. 8 and 9 are scanning electron micrographs of film top views for Example 6.

A scanning electron micrograph was made of this film by standard techniques and is shown in FIG. 8, which is a view of the surface of the clear film at a 45 degree angle and 250 magnification.

Figure 9:
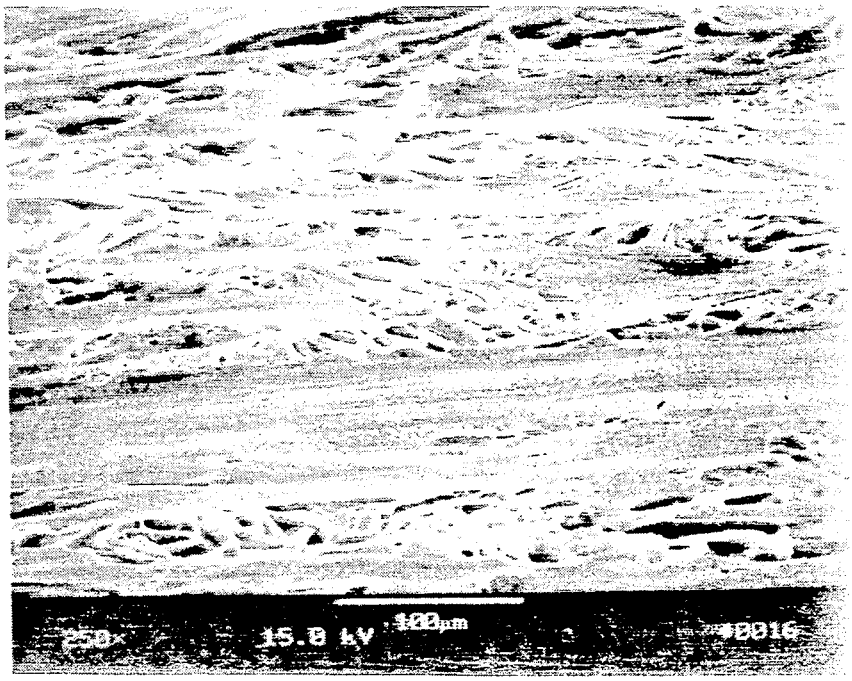

The film was then stretched by 300 percent where it turned substantially opaque. A second scanning electron micrograph was obtained and is shown in FIG. 9, which is a view of the surface of the opaque film at a 45 degree angle and 250× magnification. The stretched film shows an opening up of the film and fiber structures.

The recovery behavior of this film was also studied when stretched to elongations of 100 and 300 percent. The film was released and allowed to relax for one minute. Elastic recovery was calculated using the formula:

$$\% \text{ Elastic Recovery} = \frac{L_{stretched} - L_{recovered}}{L_{stretched} - L_{initial}} \times 100$$

The results are summarized in Table 1 below. Each sample was tested four times. The samples demonstrated that the films exhibited some elastic recovery.

TABLE 1

| Initial Length (cm) | Stretched Length (cm) | Recovered Length (cm) | Percent Recovery |
|---|---|---|---|
| 2.54 | 5.1 | 3.88 | 48% |
| 2.54 | 10.2 | 7.73 | 32% |

On subsequent stretching to the point of previous elongation, the film exhibited substantial elastic behavior.

EXAMPLE 7

A transparent film was prepared by compressing 2 layers of the BMF web of EXAMPLE 1 at 125° C. and 178,000N for approximately 60 seconds. The opacity was 1.0.

EXAMPLE 8

A 100 g/m$^2$ basis weight multilayer BMF web was prepared according to the procedure of Example 1, having an average diameter of less than about 10 micrometers, except that a polyethylene (PE) resin (ASPUN TM 6806, 105 MI, available from Dow Chemical Corporation) was substituted for the polypropylene, the first and second extruders were maintained at about 210° C., the feedblock and die were heated to about 210° C., and the melt streams were delivered to a twenty-seven layer feedblock.

A transparent film was prepared by compressing 1 layer of the BMF web at 125° C. and 178.000N for approximately 60 seconds. The opacity was 1.0.

EXAMPLE 9

A transparent film was prepared by compressing 2 layers of the BMF web of EXAMPLE 8 at 125° C. and 178,000N for approximately 60 seconds.

EXAMPLE 10

A multilayer web having a basis weight of 100 g/m$^2$ having an average diameter of less than about 10 micrometers was prepared according to the procedure of Example 8 except that the PE and PU melt stream were delivered to the twenty seven layer feedblock in a 50:50 ratio.

A transparent film was prepared by compressing 1 layer of the BMF web at 125° C. and 178,000N for approximately 60 seconds.

EXAMPLE 11

A transparent film was prepared by compressing 2 layers of the BMF web of EXAMPLE 10 at 125° C. and 178,000N for approximately 60 seconds.

EXAMPLE 12

A multilayer web having a basis weight of 100 g/m$^2$ having an average diameter of less than about 10 micrometers was prepared according to the procedure of Example 8 except that the PE and PU melt streams were delivered to the twenty seven layer feedblock in a 75:25 ratio.

A relatively transparent film was prepared by compressing 1 layer of the BMF web at 125° C. and 178,000N for approximately 60 seconds.

EXAMPLE 13

A relatively transparent film was prepared by compressing 2 layers of the BMF web of EXAMPLE 12 at 125° C. and 178,000N for approximately 60 seconds.

Tensile modulus measurements were taken on the transparent films of Examples 2–13 using dog bone shaped specimens (1.73 cm×0.47 cm) and a crosshead speed of 2.54 cm per min. on an Instron Tensile Tester (Model 1122), the values of which are reported in Table I.

TABLE I

TENSILE MODULUS VALUES for TRANSPARENT FILMS

| Example | Tensile Modulus (kPa) |
|---|---|
| 2 | 440,495 |
| 3 | 572,100 |
| 4 | 235,262 |
| 5 | 230,826 |
| 6 | 120,135 |
| 7 | 135,788 |
| 10 | 257,858 |
| 11 | 231,623 |
| 12 | 126,338 |
| 13 | 123,070 |
| 8 | 108,590 |
| 9 | 94,584 |

EXAMPLE 14

A BMF web having a basis weight of 100 g/m$^2$ and comprising twenty seven layer microfibers was prepared according to the procedure of Example 1 except that the melt was delivered to a feedblock maintained at 250° C. from two extruders which were maintained at 250° C. and 210° C. respectively, a smooth collector drum was positioned 13.2 cm from the BMF die. The PE and PU melt streams were delivered to the feedblock in a 25/75 ratio.

A transparent film was prepared by compressing the BMF web at 125° C. and 6810 kg (66.8 kN) for approximately 60 seconds.

Figure 2:
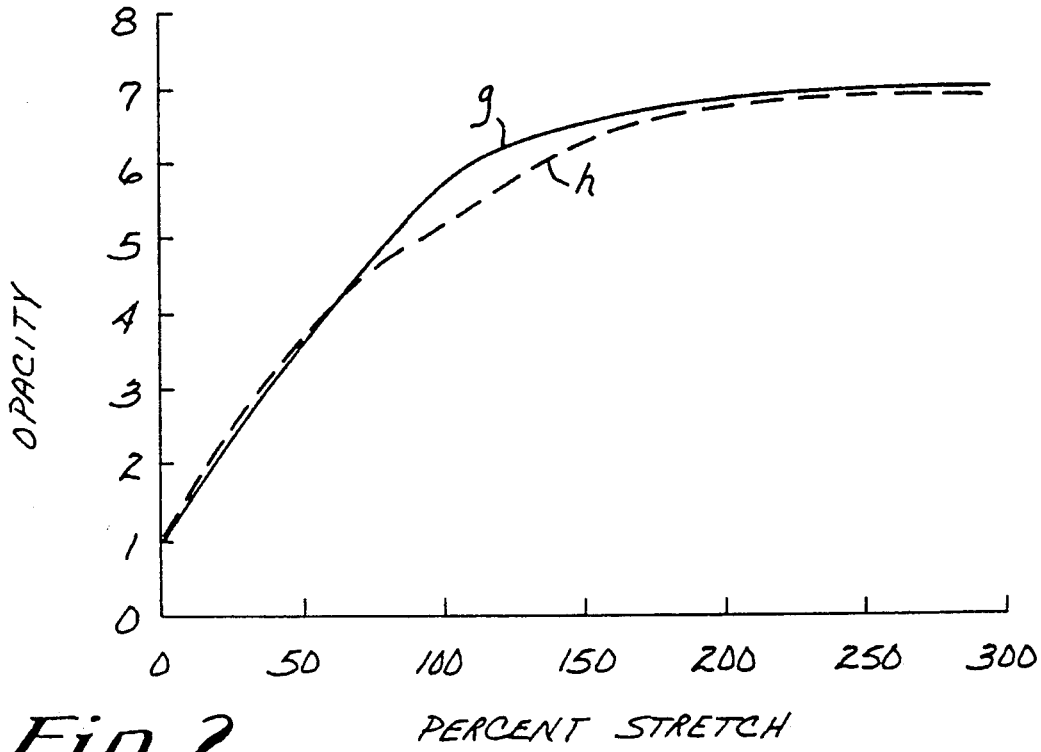
FIGS. 2 and 3 are plots of opacity change as a function of stretch for two films of the invention.

The results are shown in FIG. 2 for two samples, where the horizontal axis represents the measured percent stretch and the vertical axis represents the opacity reading. Opacity change although first measured at 50 percent elongation was noted almost immediately upon the onset of elongation. This sample readily turned opaque when stretched at low elongations.

EXAMPLE 15

A BMF web having a basis weight of 100 g/m$^2$ and comprising twenty seven layer microfibers having an average diameter of less than about 10 micrometers was prepared according the procedure of EXAMPLE 14 except that a linear low density polyethylene (PE)(ASPUN TM 6806 105 MI, available from Dow Chemical Corporation) was substituted for the PP and the PE and PU melt streams were delivered to the twenty-seven layer feedblock in a 25:75 ratio, which was maintained at 210° C. from two extruders maintained at 210° C.

Figure 3:
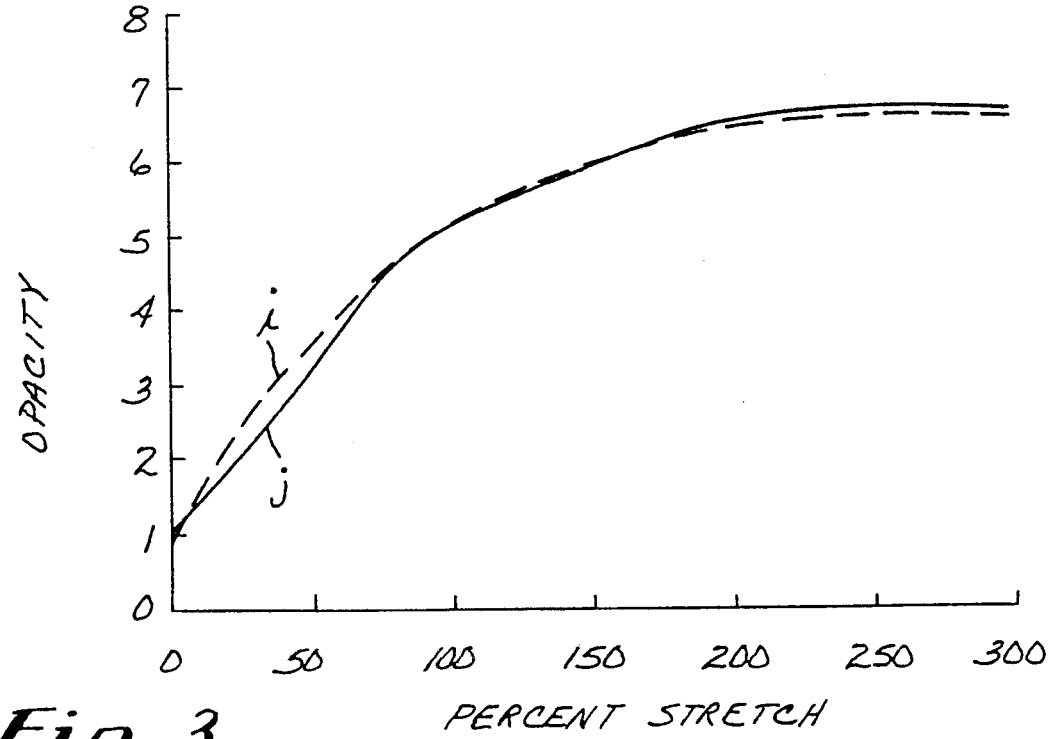

A transparent film was prepared by compressing the web at 125° C. and 6810 kg (66.8 kN). Two samples were tested for opacity changes with elongation, the results of which are shown in FIG. 3.

EXAMPLE 16

A BMF web having a basis weight of 100 g/m$^2$ and comprising two layer microfibers having an average diameter of less than about 10 micrometers was prepared according to the procedure of Example 1 except that the PP and PU melt streams were delivered to a two layer feedblock and the die and air temperatures were maintained at about 230° C.

EXAMPLE 17

A BMF web having a basis weight of 100 g/m$^2$ and comprising three layer microfibers having an average diameter of less than about 10 micrometers was prepared according to the procedure of Example 1 except that the PP and PU melt streams were delivered to a three layer feedblock.

EXAMPLE 18

A BMF web having a basis weight of 100 g/m$^2$ and comprising five layer microfibers having an average diameter of less than about 10 micrometers was prepared according to the procedure of EXAMPLE 1 except that the PP and PU melt streams were delivered to a five layer feedblock.

EXAMPLE 19

A BMF web having a basis weight of 100 g/m$^2$ and comprising twenty seven layer microfibers having an average diameter of less than about 10 micrometers was prepared according to the procedure of EXAMPLE 1 except that the PP and PU melt streams were delivered to a twenty seven layer feedblock.

EXAMPLE 20

Figure 6:
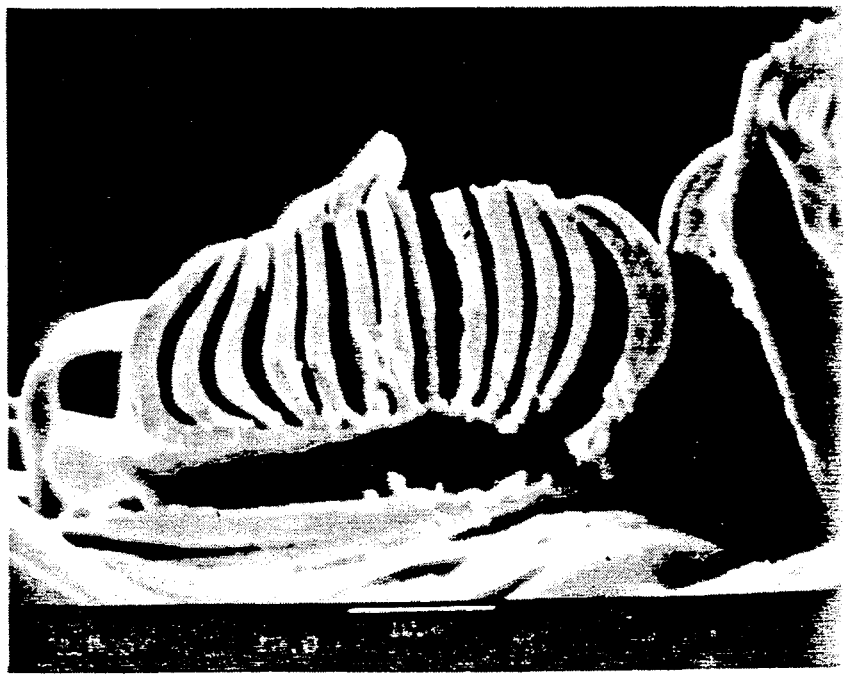

A BMF web having a basis weight of 100 g/m$^2$ and comprising twenty seven layer microfibers having an average diameter of less than about 10 micrometers was prepared according to the procedure of Example 15 except the PE and PU melt streams were delivered to the feedblock in a 75:25 ratio. A scanning electron micrograph (FIG. 6—2000×) of a cross section of this sample was prepared after the polyurethane was washed out with tetrahydrofuran. The sample was then cut, mounted and prepared for analysis by standard techniques.

EXAMPLE 21

Figure 7:
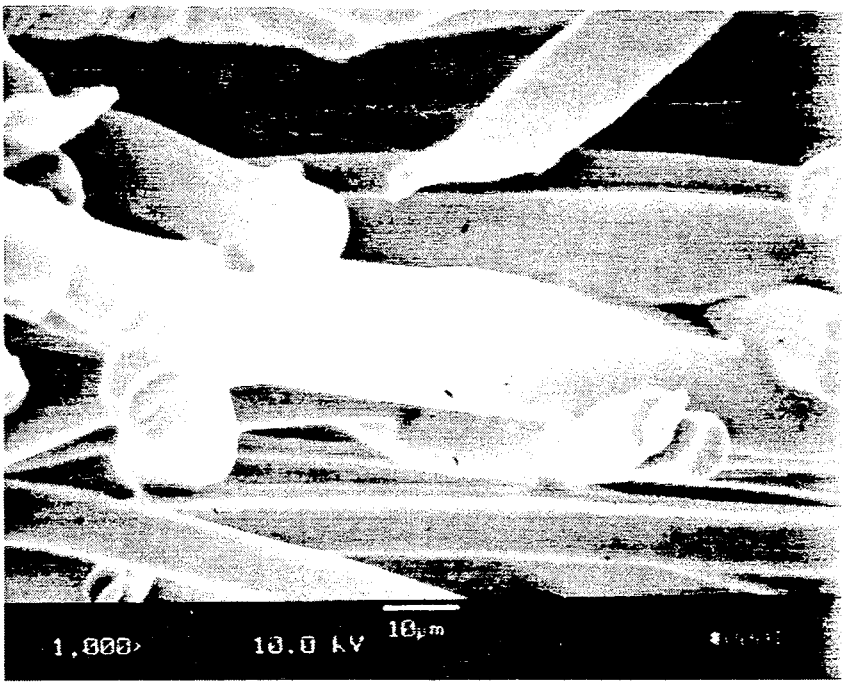
FIGS. 6 and 7 are scanning electron micrographs of web cross sections for Examples 20 and 21, respectively.

A BMF web having a basis weight of 100 g/m$^2$ was prepared according to the procedure of Example 20 except that the PE and PU melt poly(esterurethane) (PU) resin ("Morthane TM" PS440-200, available from Morton Thiokol Corp.) was substituted for the "Morthane TM" PS 455-200, the extruder temperatures were maintained at 230° C. and 230° C., respectively, the melt streams were delivered to a three layer feed block maintained at 230° C. at a 75:25 ratio, the BMF die and primary air supply temperatures were maintained at 225° C. and 215° C., respectively, and the collector distance was 30.5 cm. The samples were prepared for SEM analysis as per Example 20, except the PU was not removed; FIG. 7 (1000×).

Table 2 summarizes the modulus values for a series of BMF webs having a 25:75 PP:PU composition, but varying numbers of layers in the microfibers.

TABLE 2

Web Modulus as a Function of Layers in Microfiber
25:75 PP/PU Composition
100 g/m$^2$ Basis Weight

| Example | Number of Layers | MD Tensile Modulus (kPa) |
|---|---|---|
| 16 | 2 | 10835 |
| 17 | 3 | 11048 |
| 18 | 5 | 15014 |
| 19 | 27 | 17097 |

Figure 4:
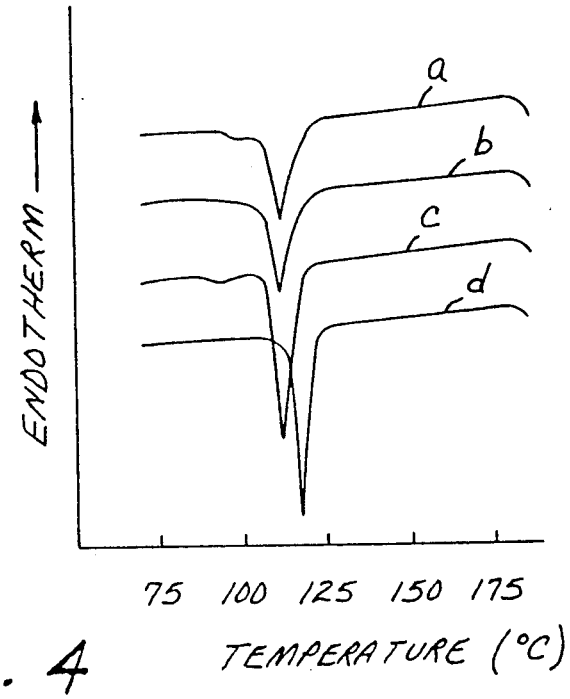
FIG. 4 is a plot of differential scanning calorimetry exotherms for Examples 16–19.
Figure 5:
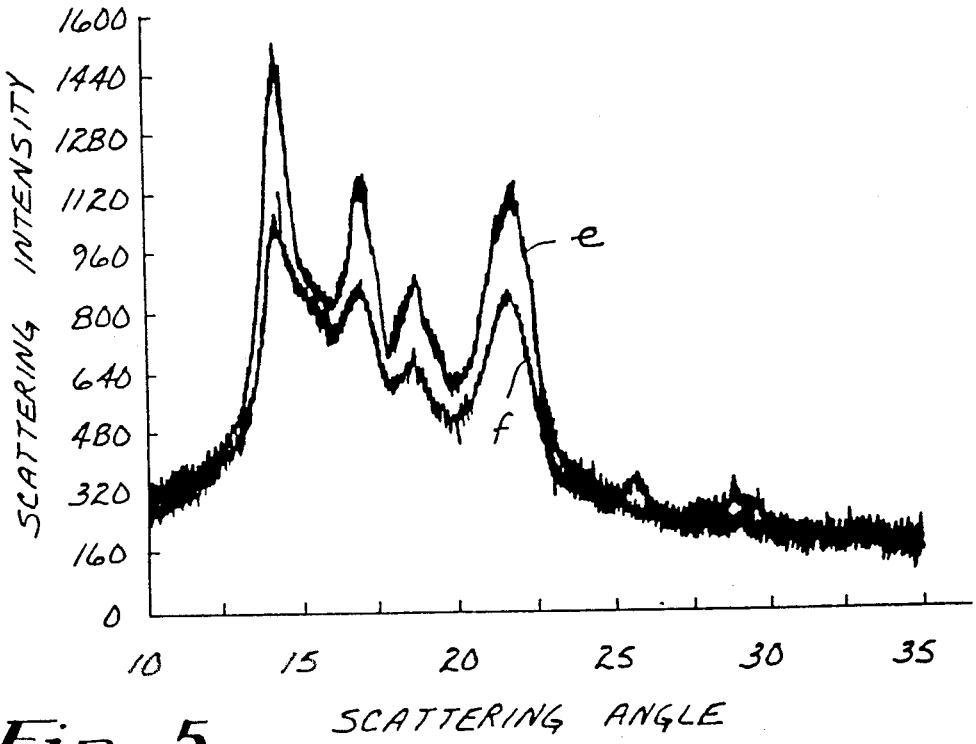
FIG. 5 is a plot of wide-angle X-ray scattering data for Examples 17 and 19.

The effect that the number of layers within the microfiber cross-section had on the crystallization behavior of the PP/PU BMF webs was studied using differential scanning calorimetry the results of which are graphically presented in FIG. 4. An examination of the crystallization exotherms for the BMF webs of Examples 16, 17, 18 and 19 (a, b, c and d, respectively), which corresponds to blown microfibers having 2, 3, 5 and 27 layers, respectively, indicates that the peak of the crystallization exotherm for the web of Example 19 is approximately 6° C. higher than the corresponding peak values for webs comprising blown microfibers having fewer layers. This data suggests that the crystallization process is enhanced in the microfibers having 27 layers, which is further supported by the examination of the wide angle X-ray scattering data that is illustrated in FIG. 5 and confirms higher crystallinity in the PP of the 27 layer microfiber web samples (e corresponds to Example 19 after washing out the PU with tetrahydrofurane solvent, and f corresponds to Example 17).

The various modifications and alterations of this invention will be apparent to those skilled in the art without departing from the scope and spirit of this invention, and this invention should not be restricted to that set forth herein for illustrative purposes.

We claim:

1. A method of forming a transparent film comprising;

forming two or more melt streams at least one of which comprises a thermoplastic elastomer and at least one of which comprises thermoplastic material, combining the melt stream into a multilayer melt stream, extruding the layered melt stream through an orifice to form multilayered microfibers by an attenuating airstream, collecting the formed microfibers as a nonwoven web, and consolidating the web under heat and pressure sufficient to soften the thermoplastic elastomeric film having a generally continuous elastomeric phase and an included array of thermoplastic material microfibers.

2. The method of claim 1 wherein the thermoplastic material microfibers in the consolidated web have an average thickness of less than 10 microns.

3. The method of claim 1 wherein the thermoplastic material microfibers in the consolidated web have an average thickness of less than 1 micron.

4. The method of claim 1 wherein the thermoplastic material microfibers in the consolidated web have an average thickness of less than 0.1 microns.

5. The method of claim 1 wherein the elastomeric phase comprises a polyurethane and the thermoplastic microfibers comprises a polyolefin.

* * * * *

UNITED STATES PATENT AND TRADEMARK OFFICE

CERTIFICATE OF CORRECTION

PATENT NO. : 5,248,455

DATED : September 28, 1993

INVENTOR(S) : Joseph et al.

It is certified that error appears in the above-identified patent and that said Letters Patent is hereby corrected as shown below:

Column 1, line 19, delete "Webs" and insert --webs--.

Column 9, line 9, delete "Morthaner™" and insert --Morthane™--.

Column 14, line 29, after the word "elastomeric" and before the word "film", insert --component for a time sufficient to form a transparent--.

Signed and Sealed this

Sixteenth Day of May, 1995

Bruce Lehman

*Attest:*

BRUCE LEHMAN

*Attesting Officer*

*Commissioner of Patents and Trademarks*